US005619879A

United States Patent [19]

Friese

[11] Patent Number: 5,619,879

[45] Date of Patent: Apr. 15, 1997

[54] METHOD FOR THE NON-CUTTING PRODUCTION OF A HUB OF A TRANSMISSION COMPONENT POSSESSING THE HUB

[75] Inventor: Udo Friese, Ahlen, Germany

[73] Assignee: WF-Maschinenbau und Blechformtechnik GmbH & Co. KG, Sendenhorst, Germany

[21] Appl. No.: 571,937

[22] PCT Filed: Feb. 23, 1994

[86] PCT No.: PCT/DE94/00209

§ 371 Date: Dec. 28, 1995

§ 102(e) Date: Dec. 28, 1995

[87] PCT Pub. No.: WO94/20235

PCT Pub. Date: Sep. 15, 1994

[30] Foreign Application Priority Data

Dec. 9, 1993 [DE] Germany ..... 43 42 086.9
Jan. 7, 1994 [DE] Germany ..... 44 00 257.2

[51] Int. Cl.[6] ..... B21H 1/00

[52] U.S. Cl. ..... 72/82; 29/894.362; 72/85

[58] Field of Search ..... 72/82, 83, 84, 72/85, 86, 87; 29/894.36, 894.362

[56] References Cited

U.S. PATENT DOCUMENTS

| | | | |
|---|---|---|---|
| 1,108,260 | 8/1914 | Slick | 72/84 |
| 1,500,261 | 7/1924 | Page | 72/82 |
| 2,624,303 | 1/1953 | Ghormley | 113/52 |
| 2,696,740 | 12/1954 | Zatko | 74/230.8 |
| 3,120,206 | 2/1964 | Sporck | 113/52 |
| 4,056,291 | 11/1977 | Kraft et al. | 308/189 |
| 4,996,859 | 3/1991 | Rose et al. | 72/86 |

FOREIGN PATENT DOCUMENTS 514584 12/1930 Germany .

OTHER PUBLICATIONS

"Blech, Rohre, Profile 1980" [Sheet Metal, Tubes, Profiles 1980], p. 660.

*Primary Examiner*—Lowell A. Larson
*Attorney, Agent, or Firm*—Merchant, Gould, Smith, Edell, Welter & Schmidt, P.A.

[57] ABSTRACT

This invention concerns a method and device for the non-cutting production of a hub (27) for a transmission component. A sheet blank (21) which is carried by a tool (3) on a main spindle (4) and rotated relative to one or more presser rollers (9, 10) is formed to produce a cylindrical prominence (7), projecting from the sheet by pressing it with a presser roller round a pin (5) mounted on the tool or a mobile stop (8) and passing through said sheet.

8 Claims, 5 Drawing Sheets

Figure 1:
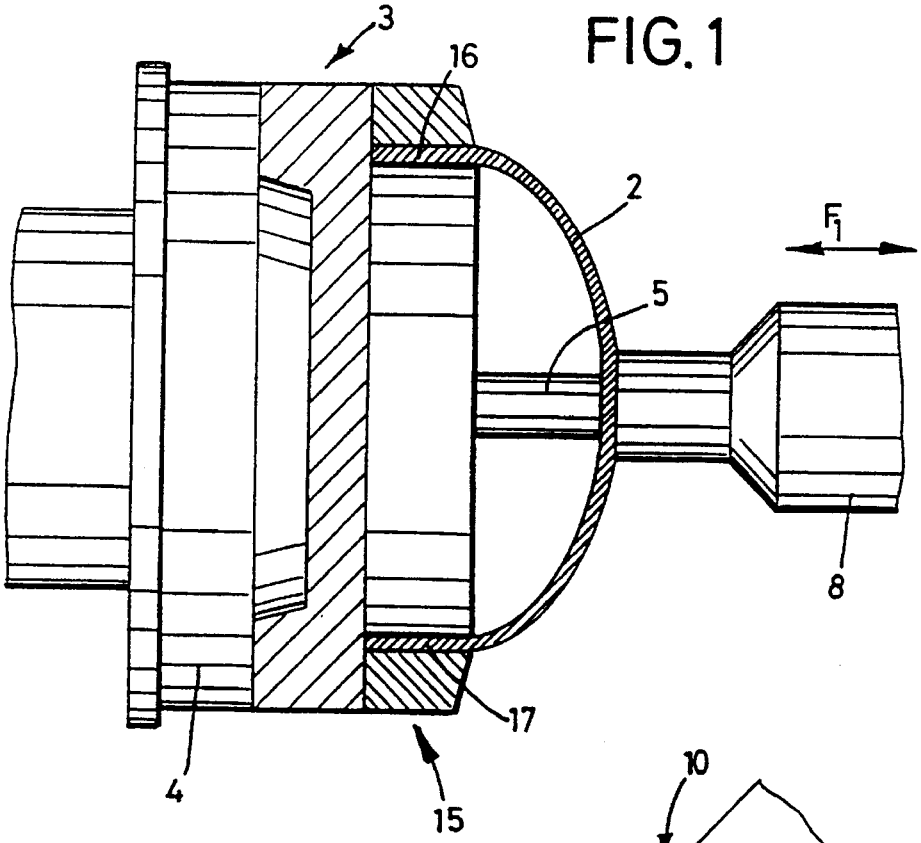

METHOD FOR THE NON-CUTTING PRODUCTION OF A HUB OF A TRANSMISSION COMPONENT POSSESSING THE HUB

The invention relates to a method for the non-cutting production of a hub of a transmission component possessing the hub from a sheet metal blank.

Transmission components designed as gear rings or designed as belt pulleys, especially poly-V-belt pulleys, are used in large numbers in automobile construction and nowadays they are often produced, starting from a round plate, by spinning methods. The formation of the toothings and/or the grooves is likewise possible by the spinning method, whereas the fitting of the necessary hub presents difficulties. The actual hub is, in the region of the axis of rotation, a sleeve-shaped part of the rotating pulley, said sleeve-shaped part making the connection with the pushed-through shaft or axle or with a journal.

Such a component is represented and described by way of example in U.S. Pat. No. 2,696,740.

The hub of a transmission component is produced, in the state of the art, by connecting a prefabricated cylindrical sleeve part to the transmission component, conventionally four methods being employed for the connection, namely, on the one hand, soldering of the two components, welding of the two components, the connection of the two components by frictional welding and, finally, it is possible also to produce the transmission component by means of a forging method.

The three first-mentioned procedures have the disadvantage that an adverse influence on the actual transmission component occurs as a result of the absolutely essential heat treatment, and, when welding takes place, subsequent machining of the weld seam is required. The cost outlay for producing the hub as a lathe-turned part is relatively high.

The distortion of the transmission component caused by the heat treatment must subsequently be removed again by means of certain machining methods.

The reject rate of transmission components from such a production line which are not true-running is very high.

The use of forged transmission components is cost-intensive and, moreover, an undesirable metal hardening occurs, that is to say the structure is changed, so that the subsequent application of the profilings of the transmission component, whether as a gear ring or as grooves for belt pulleys, becomes extremely difficult. Finally, the surface of this transmission component scales, thus necessitating additional machining steps.

In summary, therefore, it can be stated that the previous outlay for fixing a hub to a relatively small transmission component is very high, that the reject rate during manufacture is high, and undesirable influences on the material occur which may be detrimental to the useful life of the transmission component.

It is known from the literature reference "Blech, Rochre, Profile 1980" ["Sheet Metal, Tubes, Profiles 1980"], page 660, to produce outer disk carriers as a sheet-steel formed part, these outer disk carriers being manufactured in two pressing passes. Altogether, 27 processing steps are required to produce such an outer disk carrier. They comprise 10 drawing, 7 calibrating, ironing and 7 cutting operations as well as 1 upsetting operation. As a result of the drawing work, the structure is torn apart, that is to say the material structure is fatigued. Moreover, drawing operations are normally associated with inaccuracies which can have an adverse effect in the case of a transmission component.

The object on which the invention is based is to simplify the method of the relevant generic type and to carry it out in one work cycle, without undesirable influence on the material structure of the transmission component occurring.

This object on which the invention is based is achieved by means of the teaching of the main claim.

A device for carrying out this method is explained in the subclaim.

This object on which the invention is based is also achieved by means of the teaching of patent claim 3. A device for carrying out the method is explained in subclaims 5 and 6.

In other words, in contrast to the state of the art, and excluding the already mentioned forging methods and drawing methods for producing the transmission component, a one-piece transmission component is obtained, in which, by means of appropriate spinning measures, the transmission component is obtained from the round plate rotating about an axial shaft, with the hub being produced simultaneously.

It is not only possible here to ensure that the hub of the transmission component is produced in one work cycle, but it is possible, at the same time, for the wall thickness of the hub to be higher or larger than the wall thickness of the sheet metal blank of the transmission component, so that the necessary strength for transmitting the torque is achieved here.

Starting from a round plate, the hub is formed on the belt pulley intermediate product in one set-up on a spinning machine. When the method is employed, there is the possibility of producing belt pulley intermediate products for all known methods of producing belt pulleys, since the thickness in the contour region and in the profile region of the belt pulley intermediate products is fixed by the spinning method employed.

Figure 2:
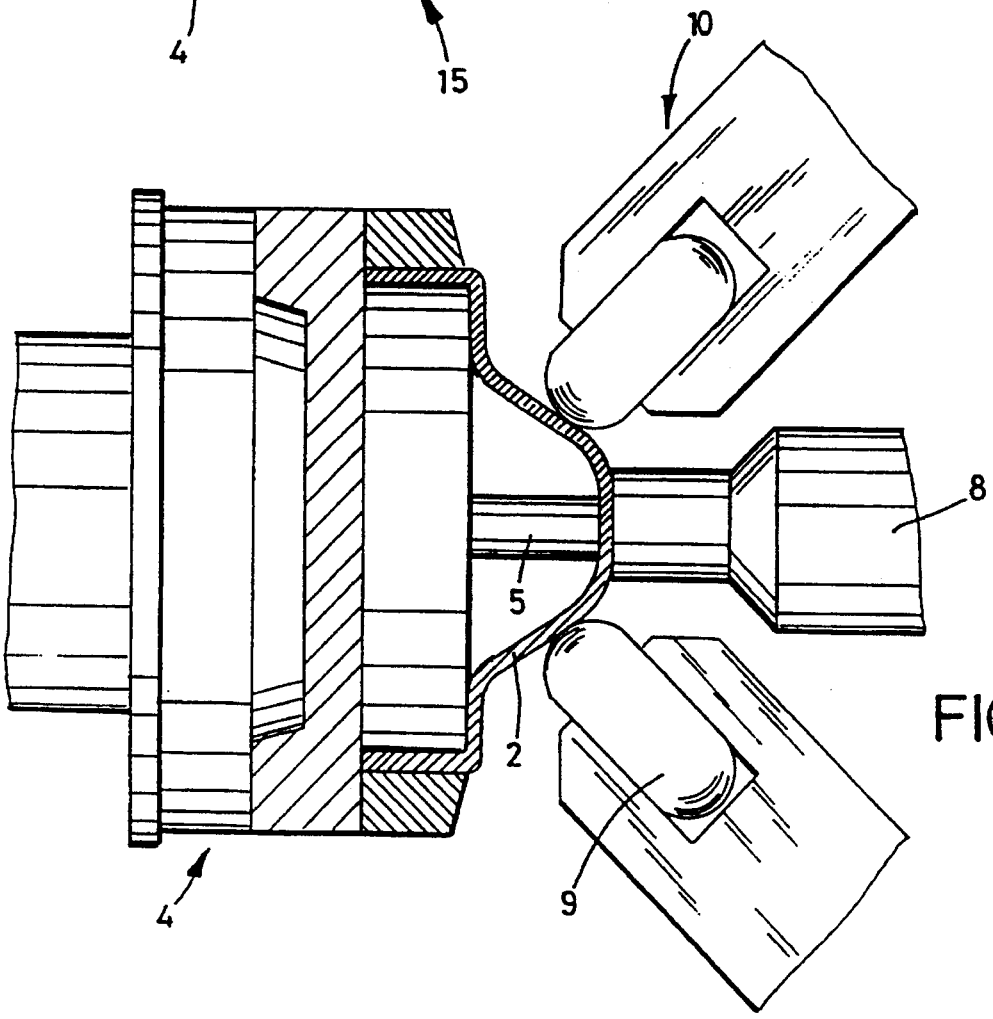
Figure 3:
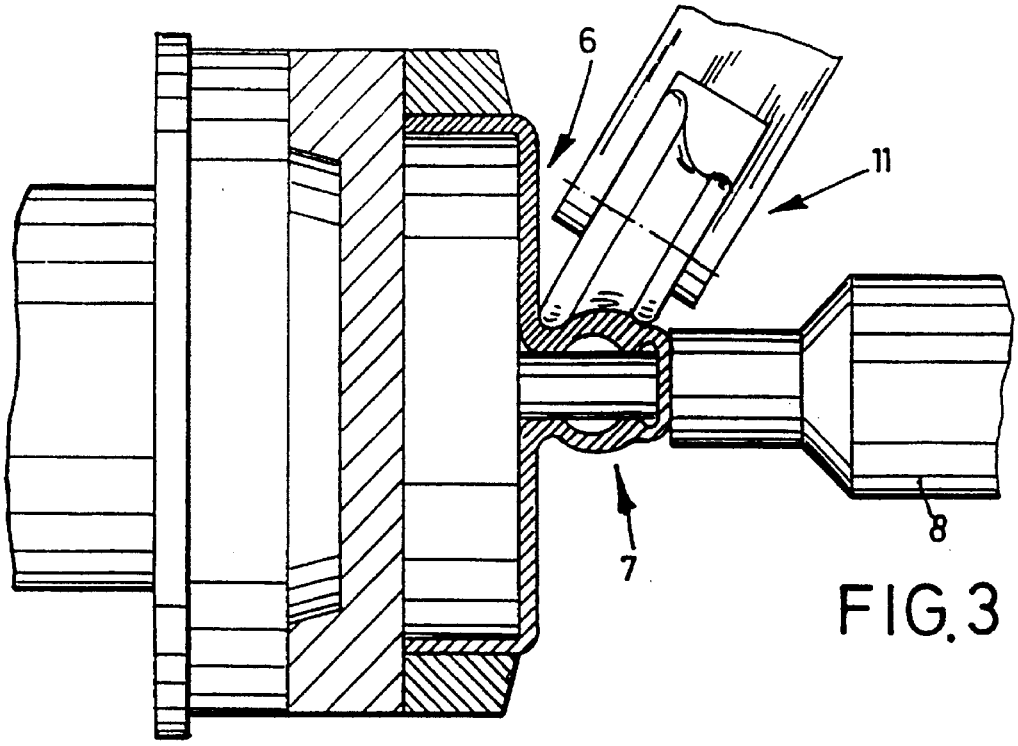
Figure 4:
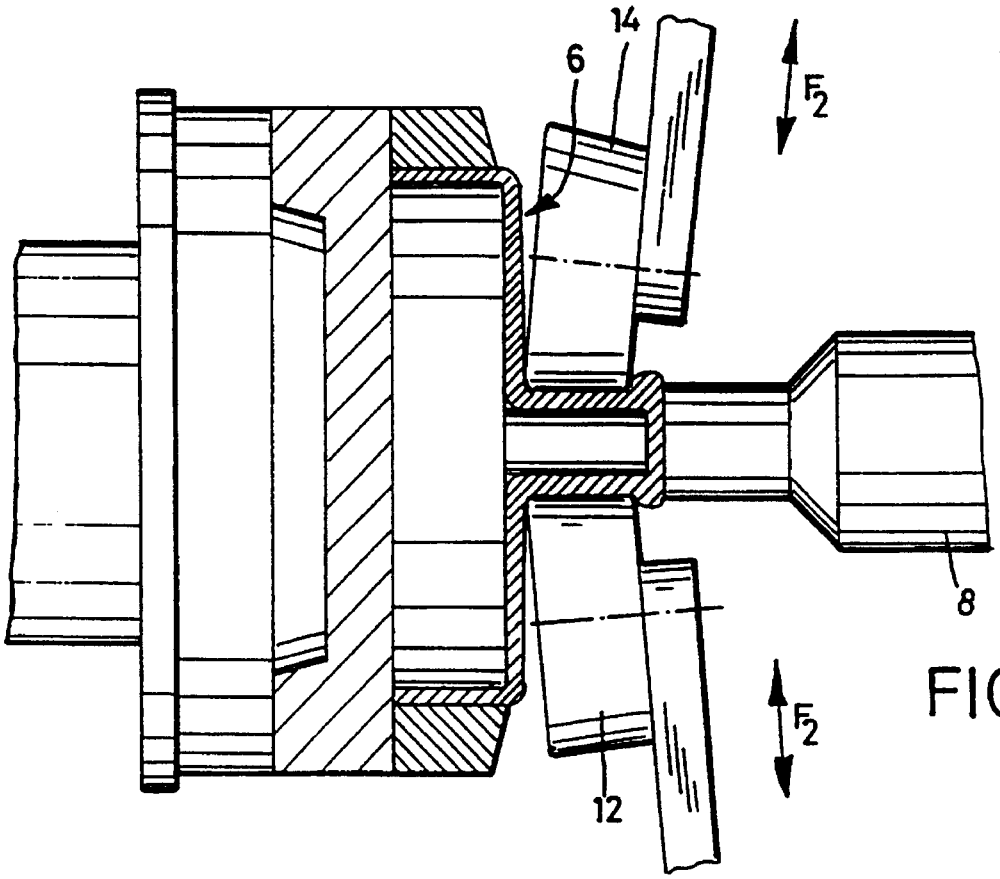
Figure 5:
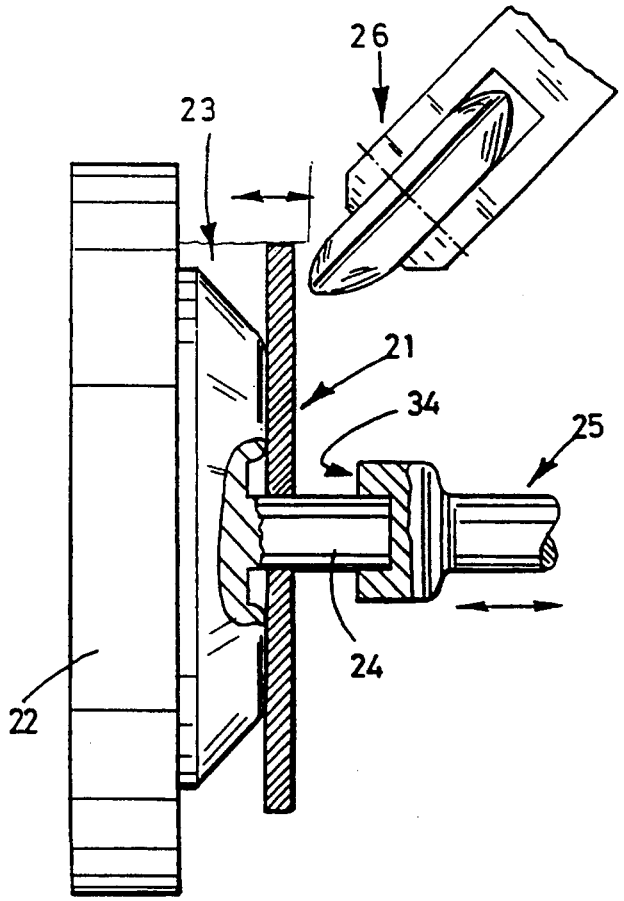
Figure 6:
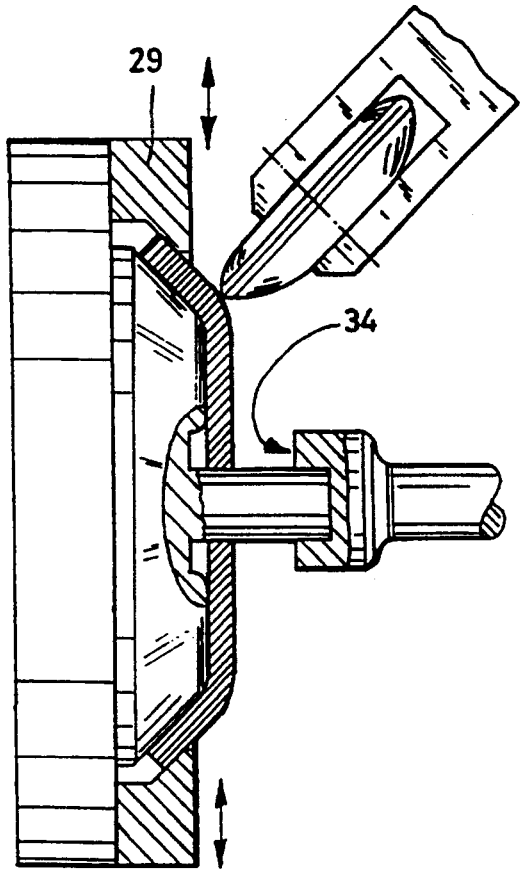
Figure 7:
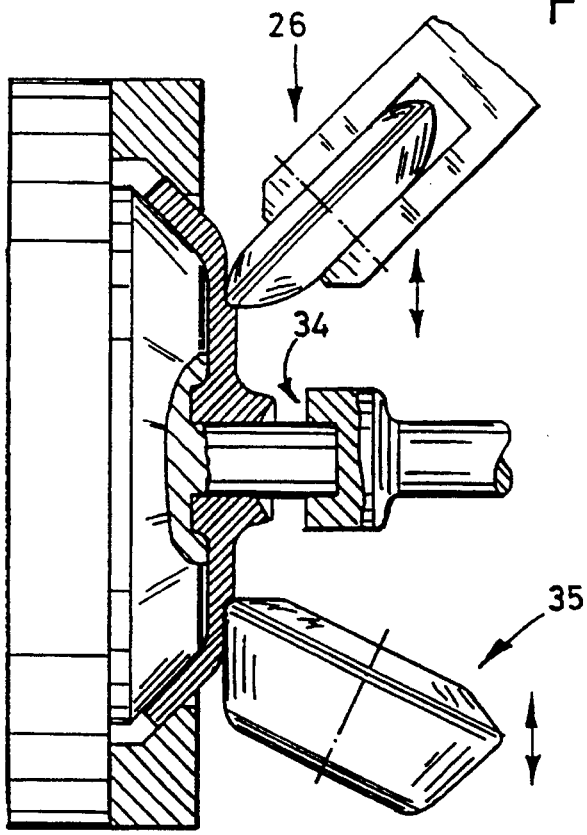
Figure 8:
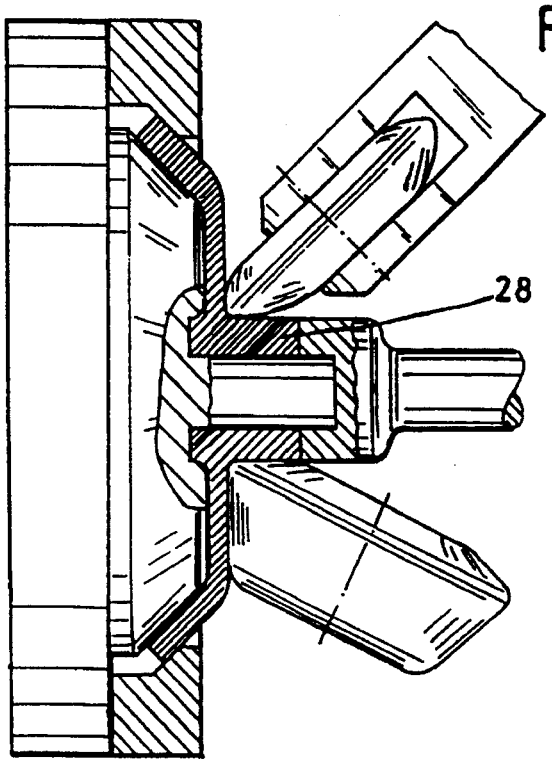
Figure 9A:
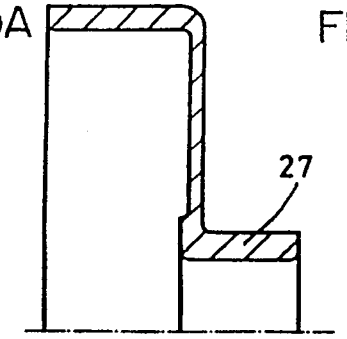
Figure 9B:
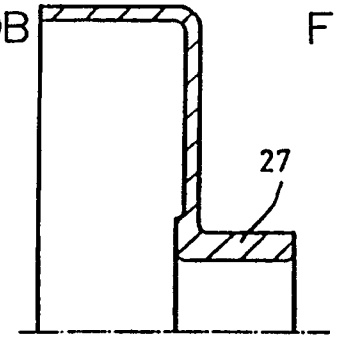
Figure 9C:
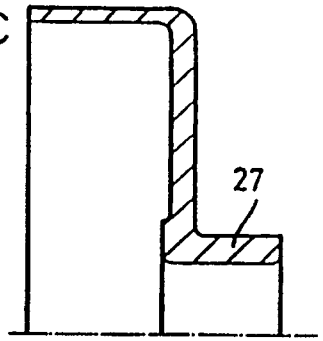
Figure 9D:
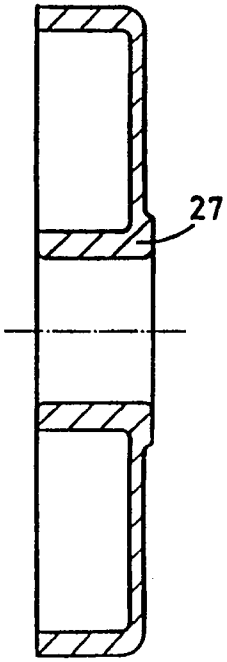
Figure 9E:
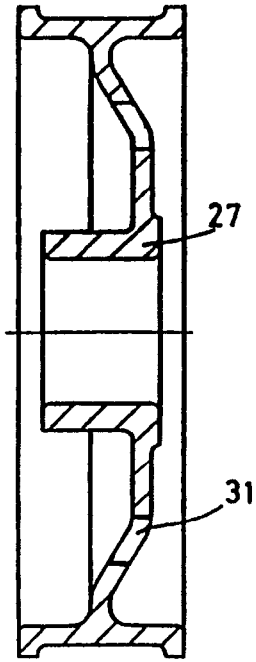
Figure 9F:
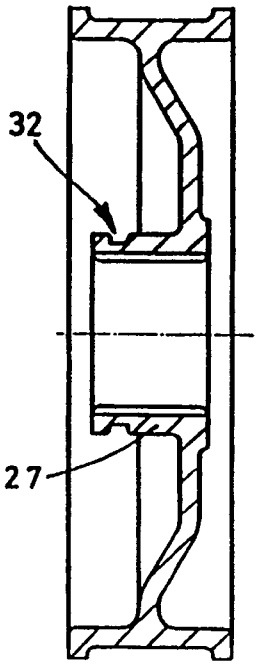
Figure 9G:
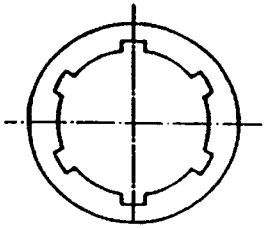

Examples of the execution of the methods according to the invention are explained below by means of the drawings. In the drawings FIG. 1 shows a clamped cap in a spinning device, FIG. 2 shows the deformation of the cap by spinning rollers, FIG. 3 shows the forming of the special cylindrical hub part by forming rollers, FIG. 4 shows the stage of final deformation by the use of thickening rollers to obtain the cylindrical hub part, FIG. 5 shows a sheet metal blank inserted into a spinning device, FIG. 6 shows the deformation of the sheet metal blank to fix the latter to the tool, FIG. 7 shows a step of the spinning method, in which the wall thickness of the transmission component is reduced and forming of the hub is thereby achieved simultaneously, and FIG. 8 shows the final stage of the spinning method, with the hub formed, and FIG. 9A to F shows a basic diagram of possible versions of belt pulley intermediate products with different thicknesses and hub positions.

FIGS. 1 to 4 show a cap 2 which is fixed to a tool 3 of a main spindle 4 by means of a clamping chuck 15 belonging to the tool 3. The tool 3 has a tool pin 5 Which projects centrically in the axial direction and which bears or comes to bear on the inside of the clamped cap 2, a movable stop 8 bearing on the outside of the cap 2.

The orientation of the flanges 16 and 17 which adjoin the cap 2 and which, in the representation of FIG. 1, run parallel to the tool pin 5 and to the axis of the main spindle 4 is unimportant.

The double arrow F marked in FIG. 1 indicates the direction of movement of the main spindle 4 and movable stop 8 for the purpose of fixing the cap 2.

FIG. 2 shows that the cap 2 is deformed in the direction of the cylindrical tool pin 5 as a result of the engagement of spinning rollers 9 and 10, the deformation then being continued, by the use of a forming roller 11 shown in FIG. 3, until the cap has been folded round the tool pin 5. During this process, the cap 2 has partially come to bear as a round plate 6 against the top side of the tool 3, whilst the remaining part of the cap 2 has been laid around the tool pin 5 in a corrugated manner according to FIG. 3.

When, as shown in FIG. 4, this corrugated region is then compressed around the tool pin 5 by thickening rollers 12 and 14, a cylindrical design of that part of the cap 2 then serving as a hub is obtained, and the wall thickness of this cylindrical projection 7 can be larger than the wall thickness of the round plate.

Of course, in this stage of the method, it is possible, by retracting the movable stop 8, to ensure that the material flows out towards the free end of the tool pin 5, so that it is also possible to make the wall thickness of the cylindrical projection 7 smaller than the wall thickness of the round plate 6.

The feed direction of the thickening rollers 12 and 14 is represented by the arrows $F_2$ in FIG. 4.

In summary, it may be stated that the proposal according to the invention affords a cost-effective production method for transmission components equipped with a hub, no structural changes being caused within the transmission component during its production, there being the possibility, at the same time, of giving the hub any wall thickness.

Proceeding from FIG. 4 of the foregoing explanations, it is now necessary to open the cylindrical projection 7, so that the latter can receive a shaft or a journal. The opening of the cylindrical projection can take place either by cutting off the bead, evident in FIG. 4, of the cylindrical projection 7, but it is also possible to open the end wall of the cylindrical projection 7 by means of bores or the like, so that the hub finally obtained then has the bead which contributes to strength. After this production method, the machining of the flanges 16 and 17 for the formation of the transmission component can then be carried out.

In FIGS. 5 to 8, 21 denotes a sheet metal blank which is arranged on a tool located on a main spindle 22, in that, in the exemplary embodiment illustrated, the tool 23 carries a tool pin 24, onto which the sheet metal blank 21 can be placed by means of a hole provided centrically in the sheet metal blank. 25 denotes a movable stop which is movable to and fro and which, in its working position, comes into contact with the tool pin 24. The movable stop 25 has, in the region towards the sheet metal blank 21, an outside diameter which is larger than the outside diameter of the tool pin 24, thereby providing an abutment, designated by 34 in the drawing, onto which the inner part of the sheet metal blank can come to bear during the deformation of the latter.

29 denotes a clamping chuck which cooperates with the tool 23 and which, after a spinning roller 26 has bent round the outer edge region of the sheet metal blank, fixes this edge region of the sheet metal blank 21, so that the sheet metal blank is thereby prevented from creeping out.

The spinning roller 21 can be moved towards the tool pin 24 in the direction of the arrow marked in FIG. 6 and at the same time, as shown particularly clearly in FIG. 7, reduces the mean wall thickness of the sheet metal blank 21, the material displaced by the spinning roller 26 flowing into the space present around the tool pin 24 and, as shown clearly in FIG. 8, coming to bear against the abutment 34, thereby providing a cylindrical projection 28 which forms the actual hub 27 according to FIG. 9 in the belt pulley intermediate product.

It can be seen from the drawing, particularly by comparison with FIGS. 6 and 8, that the edge region of the sheet metal blank 21, said end region being fixed by the clamping chuck 29, is thicker than the middle edge region of the sheet metal blank 21, and that, once again, the cylindrical projection 28 has a substantially larger material thickness than the middle edge region of the sheet metal blank 21. This wall thickness of the cylindrical projection 28 can be determined as a function of the size of the space between the abutment 34 of the movable stop 25 and the outside of the tool 23.

The follow-up roller 35 shown in FIGS. 7 and 8 prevents the material of the sheet metal blank 21 from being bent upwards during the spinning process.

FIG. 9 represents by items A to F possible versions of belt pulley intermediate products with different thicknesses and hub positions. If the belt pulley is to have a contour region K and, if appropriate, a perforation 11, as shown under E and F, this contour region, if appropriate together with the perforation, can easily be produced on a press from the belt pulley intermediate product produced by the spinning machine. There is, furthermore, the possibility of producing simple contour regions directly on the spinning machine by means of additional tool carriers.

In summary, therefore, it can be said that the spinning methods according to the invention have the following advantages in relation to the production method known hitherto:

1. Less use of machinery,
2. the material structure of the belt pulley intermediate product undergoes no adverse influences, such as, for example, during welding and forging,
3. the hub inside diameter can be produced by means of the spinning method without subsequent rolling,
4. there are no disadvantages during the profiling of the belt pulley as a result of previous work cycles,
5. there is the possibility of producing grooves or toothings on the hub inside diameter by means of the spinning method, without subsequent machining, as is evident, for example, from representation F in FIG. 9, in which the draw-off groove 32 can be produced during the spinning process.

I claim:

1. Method for the non-cutting production of a hub of a transmission component possessing the hub from a sheet metal blank, the sheet metal blank being formed into a cap, characterized in that the cap (2) is deformed by spinning around a central tool pin (5) into a cylindrical projection (7) projecting from a round plate (6) and the cylindrical projection (7) is subsequently opened in order to receive a coaxial shaft.

2. Device for the non-cutting production of a hub of a transmission component possessing the hub from a sheet metal blank, the sheet metal blank being formed into a cap, comprising a tool (3) carried by a main spindle (4), with a tool pin (5) and a clamping chuck (15) and a movable stop (8) which is arranged opposite the tool pin (5) and which, together with the tool pin (5) and the clamping chuck (15), fixes a cap (2), and spinning rollers (9, 10), forming rollers (11) and thickening rollers (12, 14) which successively load said cap (2).

3. Method for the non-cutting production of a hub of a transmission component possessing the hub from a sheet metal blank, characterized in that the sheet metal blank (21) carried by a tool (23) of a main spindle (22) and rotating relative to one or more spinning rollers (26) is reduced in thickness by spinning by means of the spinning roller (26), and the material thus obtained is deformed into a cylindrical projection (28), projecting from the sheet metal blank (21), around a tool pin (24) passing centrically through the sheet metal blank (21).

4. Method according to claim 3, characterized in that the tool pin (24) is arranged on the movable stop (25).

5. Method according to claim 3, characterized in that the tool pin (24) is arranged on the tool (23).

6. Method according to claim 3, characterized in that the edge region of the sheet metal blank (21) is fixed before the spinning process which reduces the thickness is carried out.

7. Device for the non-cutting production of a hub of a transmission component possessing the hub from a sheet metal blank, comprising a tool (23) carried by a main spindle (22), with a centric tool pin (24) and a clamping chuck (29) loading the edge region of the sheet metal blank (21) and a movable stop (25) which is arranged opposite the tool pin (24) and the outer circumference of which is larger than the outer circumference of the tool pin (24) and of which the side directed towards the sheet metal blank (21) terminates at a distance from the sheet metal blank (21) and thus forms a space by means of an abutment (34), and at least one spinning roller (26) movable parallel to the plane of the sheet metal blank (21) towards the center of the sheet metal blank (21).

8. Device according to claim 7, characterized by a follow-up roller (35) taking effect simultaneously with the spinning roller (26).

* * * * *